US011274683B2

(12) United States Patent
Neef et al.

(10) Patent No.: US 11,274,683 B2
(45) Date of Patent: Mar. 15, 2022

(54) ELECTROPNEUMATIC CONTROLLER AND PROCESS CONTROL DEVICE EQUIPPED THEREWITH

(71) Applicant: FESTO AG & Co. KG, Esslingen (DE)

(72) Inventors: Bodo Neef, Neuhausen (DE); Christoph Maile, Hochdorf (DE)

(73) Assignee: FESTO SE & CO. KG, Esslingen (DE)

( * ) Notice: Subject to any disclaimer, the term of this patent is extended or adjusted under 35 U.S.C. 154(b) by 337 days.

(21) Appl. No.: 16/608,028

(22) PCT Filed: May 3, 2017

(86) PCT No.: PCT/EP2017/060517
§ 371 (c)(1),
(2) Date: Oct. 24, 2019

(87) PCT Pub. No.: WO2018/202290
PCT Pub. Date: Nov. 8, 2018

(65) Prior Publication Data

US 2020/0191173 A1 Jun. 18, 2020

(51) Int. Cl.

| | |
|---|---|
| ***F15B 13/02*** | (2006.01) |
| ***F15B 15/20*** | (2006.01) |
| ***F15B 21/00*** | (2006.01) |
| *F15B 5/00* | (2006.01) |

(Continued)

(52) U.S. Cl.
CPC ..... *F15B 15/20* (2013.01); *F15B 21/00* (2013.01); *F15B 5/006* (2013.01); *F15B 13/0839* (2013.01); *F15B 15/202* (2013.01); *F15B 21/003* (2013.01); *F15B 2013/006* (2013.01); *F15B 2211/6336* (2013.01)

(58) Field of Classification Search
CPC ..... F15B 15/20; F15B 15/202; F15B 21/00; F15B 21/003; F15B 2013/006; F15B 2211/6336; F15B 5/006; F15B 13/0839
USPC ..... 137/14, 119.1, 269, 270, 271, 487.5, 137/565.18, 884
See application file for complete search history.

(56) References Cited

U.S. PATENT DOCUMENTS

| | | | |
|---|---|---|---|
| 3,818,800 | A | 6/1974 | Bertaux |
| 4,033,236 | A | 7/1977 | Johnson et al. |

(Continued)

FOREIGN PATENT DOCUMENTS

| | | | |
|---|---|---|---|
| CN | 101283184 | A | 10/2008 |
| CN | 101603554 | A | 12/2009 |

(Continued)

*Primary Examiner* — Minh Q Le
(74) *Attorney, Agent, or Firm* — Hoffmann & Baron, LLP

(57) ABSTRACT

An electropneumatic controller has an electropneumatic control unit on which is provided an expansion interface, on which an expansion module arrangement is fitted. In the expansion module arrangement there extends at least one expansion working channel which is connected to a main working output and which is fluidically connected to the control unit at the expansion interface for connection to control valve means. The control unit further contains control electronics for electrically controlling the control valve means. Also proposed is a process control device equipped with a controller of this type.

20 Claims, 4 Drawing Sheets

(51) Int. Cl.
*F15B 13/00* (2006.01)
*F15B 13/08* (2006.01)

(56) References Cited

U.S. PATENT DOCUMENTS

| | | | | |
|---|---|---|---|---|
| 4,224,957 | A * | 9/1980 | Darves | F15B 13/0817 137/270 |
| 5,457,594 | A * | 10/1995 | Stoll | F15B 13/0832 361/160 |
| 5,915,409 | A * | 6/1999 | Kaneko | F15B 13/0814 137/270 |
| 6,189,571 | B1 * | 2/2001 | Hedlund | F15B 13/081 137/269 |
| 7,171,985 | B2 * | 2/2007 | Eltrop | F15B 13/0817 137/269 |
| 7,204,273 | B1 * | 4/2007 | Zub | F15B 13/0814 137/884 |
| 7,938,145 | B2 * | 5/2011 | Phillips | F16K 27/003 137/884 |
| 10,927,861 | B2 * | 2/2021 | Neef | F15B 15/202 |
| 2003/0097923 | A1 * | 5/2003 | Muth | F15B 13/0405 91/54 |
| 2003/0155025 | A1 * | 8/2003 | Camozzi | F16K 27/003 137/884 |
| 2009/0199703 | A1 * | 8/2009 | Hoffmann | F15B 5/006 91/361 |
| 2014/0116241 | A1 * | 5/2014 | Valentin-Rumpel | F15B 5/006 91/361 |
| 2016/0062368 | A1 * | 3/2016 | Wagner-Stuerz | F15B 20/008 700/282 |
| 2017/0328383 | A1 * | 11/2017 | Neef | F15B 13/0889 |
| 2018/0156245 | A1 * | 6/2018 | Modinger | F15B 15/202 |
| 2018/0245608 | A1 * | 8/2018 | Doll | F15B 11/04 |
| 2018/0320714 | A1 * | 11/2018 | Neef | F15B 13/0401 |
| 2019/0195246 | A1 * | 6/2019 | Jamison | F15B 13/0821 |
| 2019/0264712 | A1 * | 8/2019 | Lucidera | F15B 13/0825 |
| 2020/0232483 | A1 * | 7/2020 | Biwersi | F15B 13/0867 |

FOREIGN PATENT DOCUMENTS

| | | | |
|---|---|---|---|
| CN | 103443476 | A | 12/2013 |
| CN | 205155298 | U | 4/2016 |
| DE | 19636418 | A1 | 3/1998 |
| DE | 10350305 | A1 | 5/2005 |
| EP | 0930130 | A2 | 7/1999 |
| FR | 2403479 | A1 | 4/1979 |

* cited by examiner

ELECTROPNEUMATIC CONTROLLER AND PROCESS CONTROL DEVICE EQUIPPED THEREWITH

This application claims priority based on an International Application filed under the Patent Cooperation Treaty, PCT/EP2017/060517, filed on May 3, 2017.

BACKGROUND OF THE INVENTION

The invention relates to an electropneumatic controller with an actuator mounting interface for attaching to a pneumatic actuator and with an electropneumatic control unit comprising control electronics designed for processing feedback signals of the actuator and control valve means electrically controllable by the control electronics, the control unit having at least one pneumatic main working outlet for pneumatic connection to a drive chamber of the actuator to be controlled. The invention further relates to a process control device having an actuator and an electropneumatic controller for the actuator.

From DE 19636418 A1, a pneumatic actuator is known which is equipped with an electropneumatic controller of the type referred to above, which has an electropneumatic control unit designed as a position controller. The control unit has at least one pneumatic main working outlet connected to a drive chamber of the pneumatic actuator. Depending on feedback signals of the actuator, which in turn depend on the position of a drive rod of the actuator, a controlled pressure is applied to the drive chamber to control the position of the drive rod. The position controller is of modular design internally and can within its housing be optionally equipped with various functional units in order to vary the position controller type between pneumatic, electropneumatic and digital configurations.

SUMMARY OF THE INVENTION

The invention is based on the problem of taking measures which facilitate a simple variation of the functionality of the electropneumatic controller and a process control device equipped therewith while keeping dimensions compact.

To solve this problem, it is provided in an electropneumatic controller of the type referred to above that the control unit has an extension interface on which at least one pneumatic extension working outlet communicating with the control valve means and at least one pneumatic extension working inlet communicating with a pneumatic main working outlet are provided, and that the controller has an extension module assembly attached or able to be attached to the extension interface, wherein at least one extension working passage connecting an extension working outlet of the control unit to an extension working inlet of the control unit passes through the extension module assembly, and wherein the extension module assembly contains a diverting module redirecting the extension working passage from the extension working outlet to the extension working inlet.

The problem is further solved in a process control device of the type referred to above by providing that the controller is designed in the above manner and attached to the actuator by its actuator mounting interface.

In this way, an extension module assembly through which compressed air fed to the actuator for its actuation flows is incorporated into the fluid connection between the control valve means of the control unit and the at least one working outlet likewise designed as a part of the control unit and provided for connection to a drive chamber of the actuator to be controlled. For attaching the extension module assembly, the control unit is equipped with a mounting interface described as an extension interface, where the at least one extension working outlet and the at least one extension working inlet are located as well, so that an extension working passage passing through the extension module assembly communicates at one end with the extension working outlet and at the other end with the extension working inlet if the extension module assembly is fitted to the extension interface. The extension working passage is effectively looped through the existing modules of the extension module assembly, wherein, if the extension module assembly is equipped accordingly, it is possible to influence the compressed air used for the actuation of the connected actuator, in particular independently of the electropneumatic control unit. In accordance with its name, the extension module assembly is a modular device which can be put together in a variable and application-specific manner. As a core component, it has a diverting module which diverts each extension working passage from its extension working outlet to its extension working inlet and ensures that compressed air fed, starting from the control unit, into the extension module assembly is returned to the control unit after passing through the extension module assembly. If no special compressed air treatment is required for a specific application, the extension module assembly even offers the possibility of attaching only a diverting module as a single module to the extension interface, thereby creating a function-less fluidic connection between the at least one extension working outlet and the associated at least one extension working inlet.

Advantageous further developments of the invention emerge from the dependent claims.

The controller can be or is attached to the actuator to be controlled by the actuator mounting interface provided. This actuator mounting interface is expediently located on the electropneumatic control unit, so that the extension module assembly can be manipulated without having to remove the control unit from the actuator.

If the actuator to be controlled is a so-called single-acting actuator, the extension working inlet, the extension working outlet and the main working outlet can be provided as single units, and only a single extension working passage passes through the extension module assembly. The electropneumatic controller can, however, also be designed for controlling a double-acting actuator by providing two of each of the above components and accordingly providing the diverting module with passages suitable for diverting both extension working passages independently of each other.

It is deemed to be particularly advantageous to provide the diverting module as an end module of the extension module assembly which completes the extension module assembly on the side opposite the control unit. In this case the distance of the diverting module from the control unit depends on the number and dimension of further modules of the extension module assembly incorporated between the control unit and the diverting module serving as end module of the extension module assembly.

The control unit receives its functional variability in combination with an extension module assembly having at least one functional module acting together with the compressed air flowing through the extension module assembly. The functional module is in particular designed such that it can influence the compressed air flowing in the extension module assembly during the operation of the controller and/or such that it can itself be influenced by the compressed air flowing in the extension module assembly, wherein both the influencing facility and the influenceability can be predetermined by the functional features of the respective functional module.

In terms of equipment, the diverting module can be limited to passage means for mere passage diversion of the at least one extension working passage. Alternatively, there is the advantageous possibility of simultaneously designing the diverting module as a functional module of the type explained above, so that, in addition to mere passage diversion, is has at least one special functionality reflected in a special interaction with the compressed air. The diverting module can for example at the same time form an air feed-in module usable for feeding in air or an air treatment module for treating compressed air.

The controller can display its special advantages if the extension module assembly has at least one functional module separate from the diverting module, which is or can be installed between the diverting module and the control unit. The extension module assembly preferably contains several functional modules separate from the diverting module with different functionality, which are or can be installed in a row between the control unit and the diverting module. In this, all modules of the extension module assembly are preferably lined up and fixed to one another in a linear line-up direction. A mutually offset, non-linear line-up is also possible.

The placing sequence of the functional modules of the extension module assembly can preferably be chosen arbitrarily. This facilitates a later retrofit or modular extension of the extension module assembly by further modules.

Each functional module expediently has two coupling interfaces located opposite each other, which are designed such that functional modules of different functionality can be installed in any sequence between the control unit and the diverting module. The diverting module also expediently has such a coupling interface at least on the side facing the control unit, so that it can be connected to any adjacent functional module.

The coupling interfaces are expediently adapted to the extension interface in such a way that they can be combined therewith in order to be able to attach a functional module or alternatively directly the diverting module to the extension interface, depending on the equipment of the extension module assembly.

The extension module assembly expediently contains any number of functional modules from the group comprising an air treatment module, an indicating module used for pressure indication in particular, a restrictor module, and interrupt module, a manual operation module, an emergency shutoff module, a booster module and an air feed-in module. The line-up sequence of the functional modules selected from this group is preferably variable within the extension module assembly.

The controller comprises at least one air feed-in port for feeding in the compressed air used for controlling the actuator. Such an air feed-in port, which may be a single air feed-in port, is located at the control unit in an expedient configuration. In addition or as an alternative, there may be an air feed-in port at the extension module assembly, in particular at one of the functional modules provided in any number; this then acts as an air feed-in module.

The at least one air feed-in port can, if provided at the control unit, communicate directly with the control valve means without any participation of the extension module assembly. It is deemed particularly advantageous, however, if an extension air supply passage connected to at least one air feed-in port on the one hand and to the control valve means in the control unit on the other hand passes through the extension module assembly. In this way, the compressed air fed to the control valve means flows through the extension module assembly as well and can there be influenced as desired in at least one functional module.

At the extension interface of the control unit, an extension supply outlet communicating with an air feed-in port of the control unit and an extension supply inlet communicating with the control valve means in the control unit are expediently formed, wherein an extension air supply passage passing through the extension module assembly is connected to the extension supply outlet on the one hand and to the extension supply inlet on the other hand. Like the at least one extension working passage, this extension air supply passage is diverted in the diverting module, so that the compressed air is fed from the control unit into the extension module assembly and after passing through the extension module assembly is returned to the control unit for use.

Like the at least one extension working passage, the extension air supply passage can therefore be looped through the extension module assembly. If there is an air feed-in port at the extension module assembly, the extension working passage may nevertheless still be complete, being however only used with one passage section leading from the air feed-in port to the extension supply inlet, while the passage section leading from the air feed-in port to the extension supply outlet is not used and is expediently closed down by suitable shutoff means.

The extension interface fitted with the extension module assembly is preferably separate from the actuator mounting interface provided for attaching the controller to an actuator. The two interfaces are preferably oriented at right angles to each other, but can have another orientation as well.

The control unit is or can be attached to a matching mounting interface of the actuator by the actuator mounting interface. In this context, an embodiment is possible in which the controller is attached to the actuator independently of the fluidic connection of the at least one working outlet and a drive chamber of the actuator, so that this fluidic connection is established separately, for example by means of pipelines or compressed air hoses. As particularly advantageous, however, a further development is found in which the main working outlet is located at the actuator mounting interface of the control unit in such a way that there is a direct adaptation to the actuator, i.e. that there is a direct fluidic connection between the at least one working outlet and a corresponding port of the actuator if the control unit is attached to an actuator. This greatly simplifies the mounting and removal of the controller at or from the actuator.

The control unit can be provided in various functional manifestations. In a preferred case, it contains at least one feedback signal inlet, control electronics and as control valve means at least one pilot-controlled electrically actuable valve designed as a solenoid valve in particular.

The feedback signals can be fed into the control unit from outside or, in a suitable configuration, generated within the control unit, which in this case is provided with suitable feedback means.

The control unit can be designed for an unregulated operation in which it only receives simple sensor signals. It can, however, also be designed for regulated operation in which it receives continuous position signals, i.e. distance measurement signals, as feedback signals.

In a particularly advantageous variant, the control unit is designed as a positioning unit, which can also be described as a positioner and the control electronics of which have a closed-loop control functionality. The positioning unit communicates with a higher-order and preferably external electronic control device from which it receives the target value to be set, whereby the actuator is controlled in its actuating function.

The electrically actuable control valve means can comprise one control valve only or a group of control valves. The control valve means preferably have a steady function characteristic and are designed for pulse width-modulated operation. They can be designed for direct actuation by the control signals provided by the control electronics or be of an electropneumatically pilot-controlled construction. It is advantageous if the positioning unit has an e/p-converter as a pilot stage, in particular one which operates in accordance with the flapper-and-nozzle principle.

The control unit can have a unitary structure without any modularity. A modular structure is preferred, however. A particularly expedient modular structure provides that the control unit has a control module and a separate passage splitter module, wherein the control module can be or is attached to the passage splitter module in a preferably releasable manner. The control module at least contains the control electronics and the connected control valve means as well as at least one feedback signal input suitable for receiving feedback signals, in particular position signals. The closed- or open-loop control functionality is therefore contained in the control module. The passage splitter module has the function of dividing passages between the control module and the extension module assembly. The extension interface including the at least one extension working outlet and the at least one extension working inlet is provided at the passage splitter module. The passage splitter module communicates with the control valve means in the control module via internal fluidic interfaces of the control unit to establish the required fluid connection.

The actuator mounting interface is preferably formed at the passage splitter module as well. In this way, the control module is decoupled from mechanical loads, because it is fixed to the passage splitter module independently of the extension module assembly and the actuator. The control module can be removed if required, wherein the passage splitter module continues to hold together the extension module assembly and the actuator as an assembly.

In a preferred application, the controller is an integral part of a modular process control device, which also includes an actuator to which the controller is attached by its actuator mounting interface.

The actuator is a linear actuator in particular, for example a piston or diaphragm drive, or else a rotary actuator. The actuator can be used for various purposes. It is particularly advantageous if it is a part of a process valve which also has a valve fitting which can be incorporated into a pipeline and actuated by the actuator.

BRIEF DESCRIPTION OF THE DRAWINGS

The invention is explained in greater detail below with reference to the enclosed drawing, of which.

DETAILED DESCRIPTION

Figure 1:
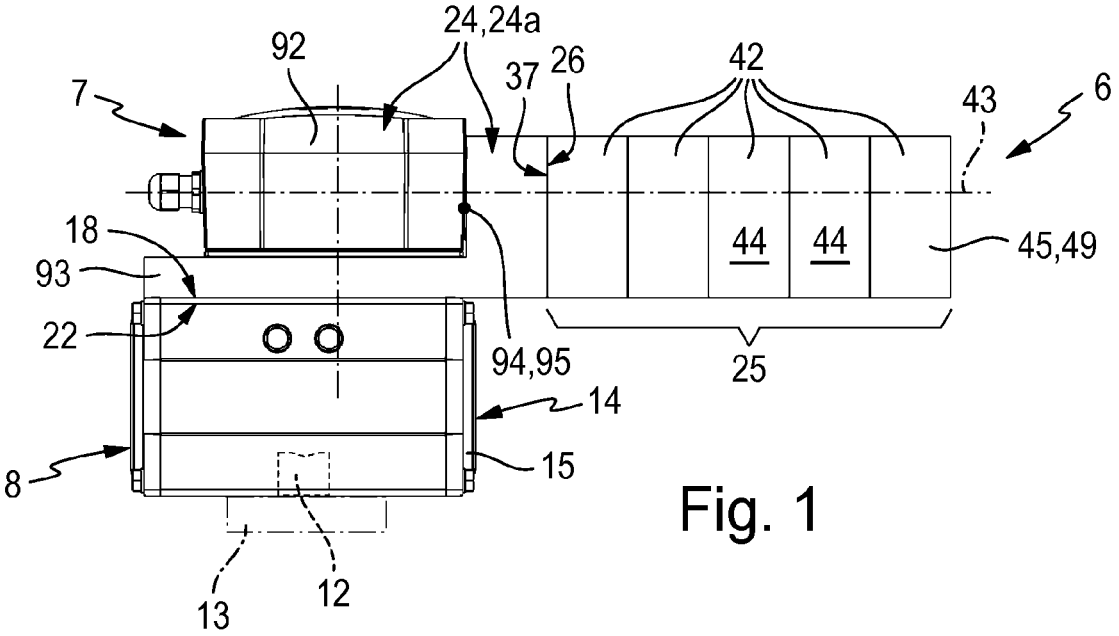
FIG. 1 is a side view of a preferred first embodiment of the process control device according to the invention, containing a controller of an advantageous design according to the invention.

The figures of the drawing in each case illustrate a process control device 6 as a whole, which has an electropneumatic controller 7 as a main component.

Figure 3:
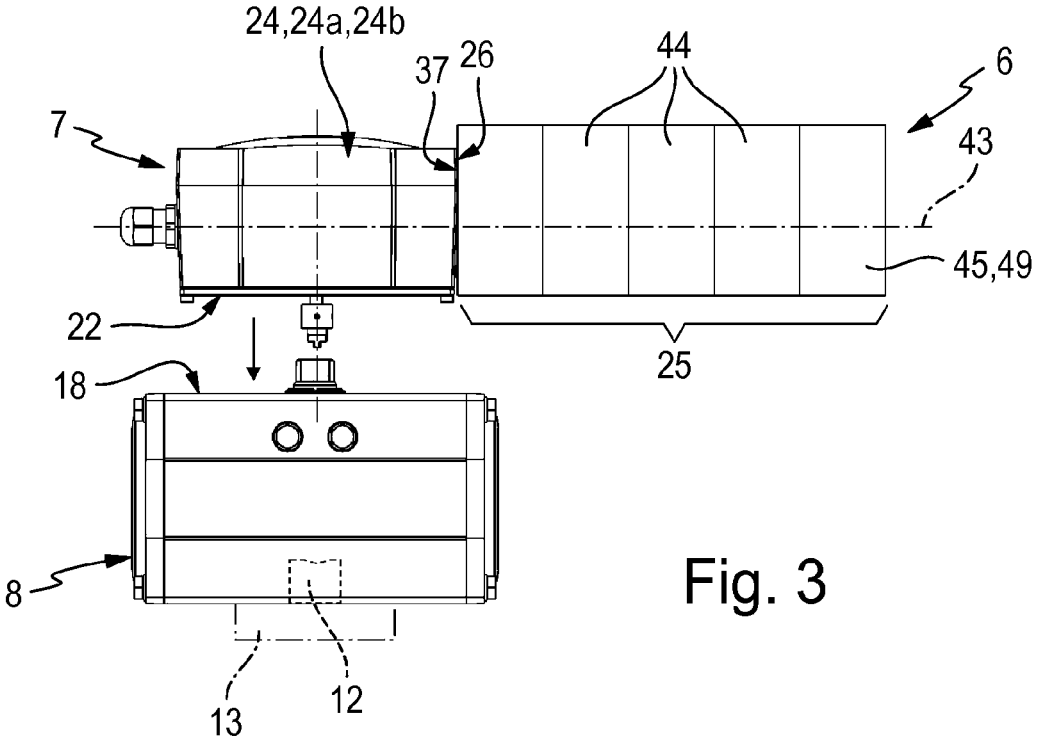
FIG. 3 shows a further embodiment of the process control device according to the invention with a controller according to the invention wherein, in contrast to the embodiment of FIGS. 1 and 2, the control unit does not have a separate passage splitter module.
Figure 2:
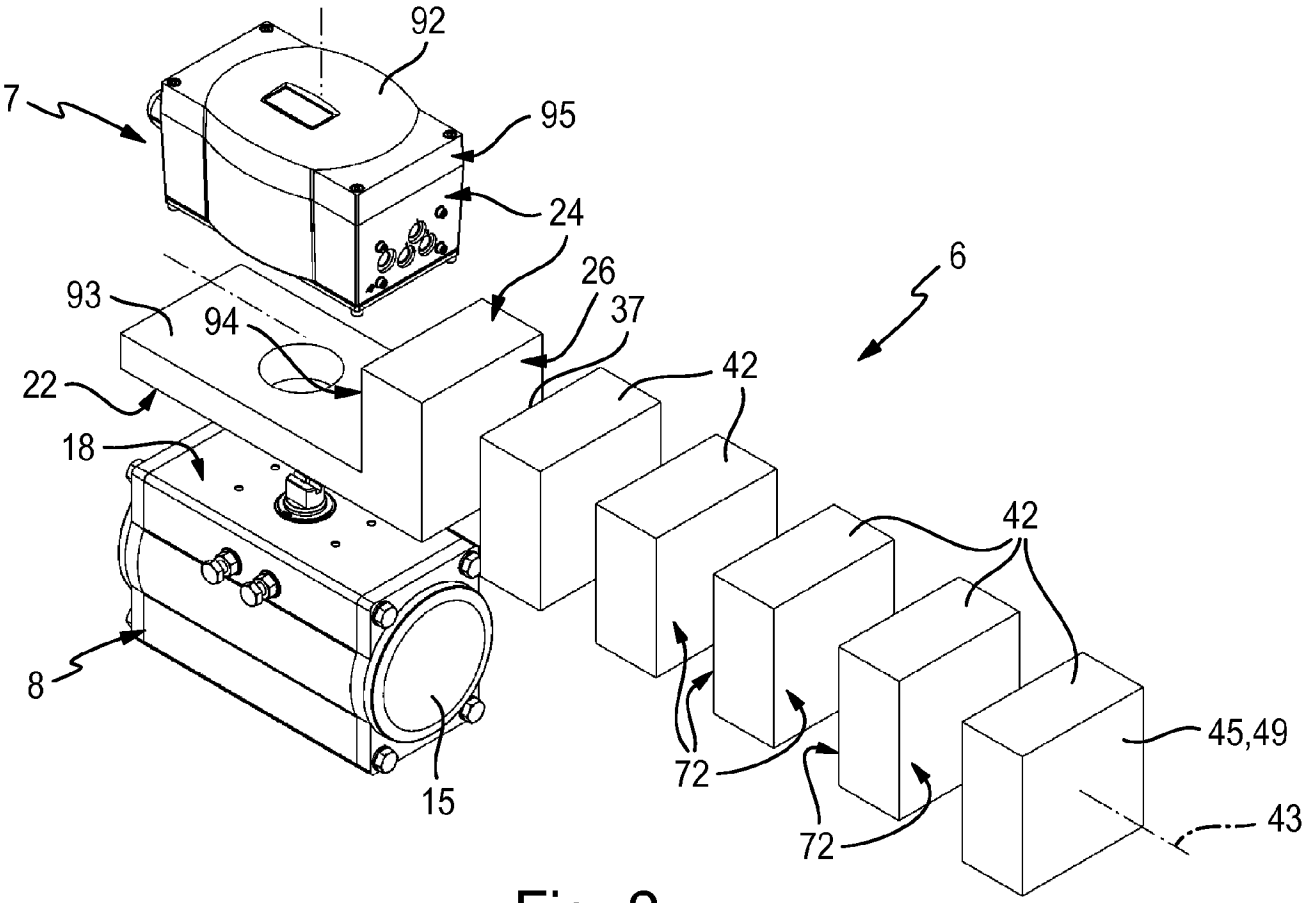
FIG. 2 is an exploded perspective view of the arrangement from FIG. 1.
Figure 4:
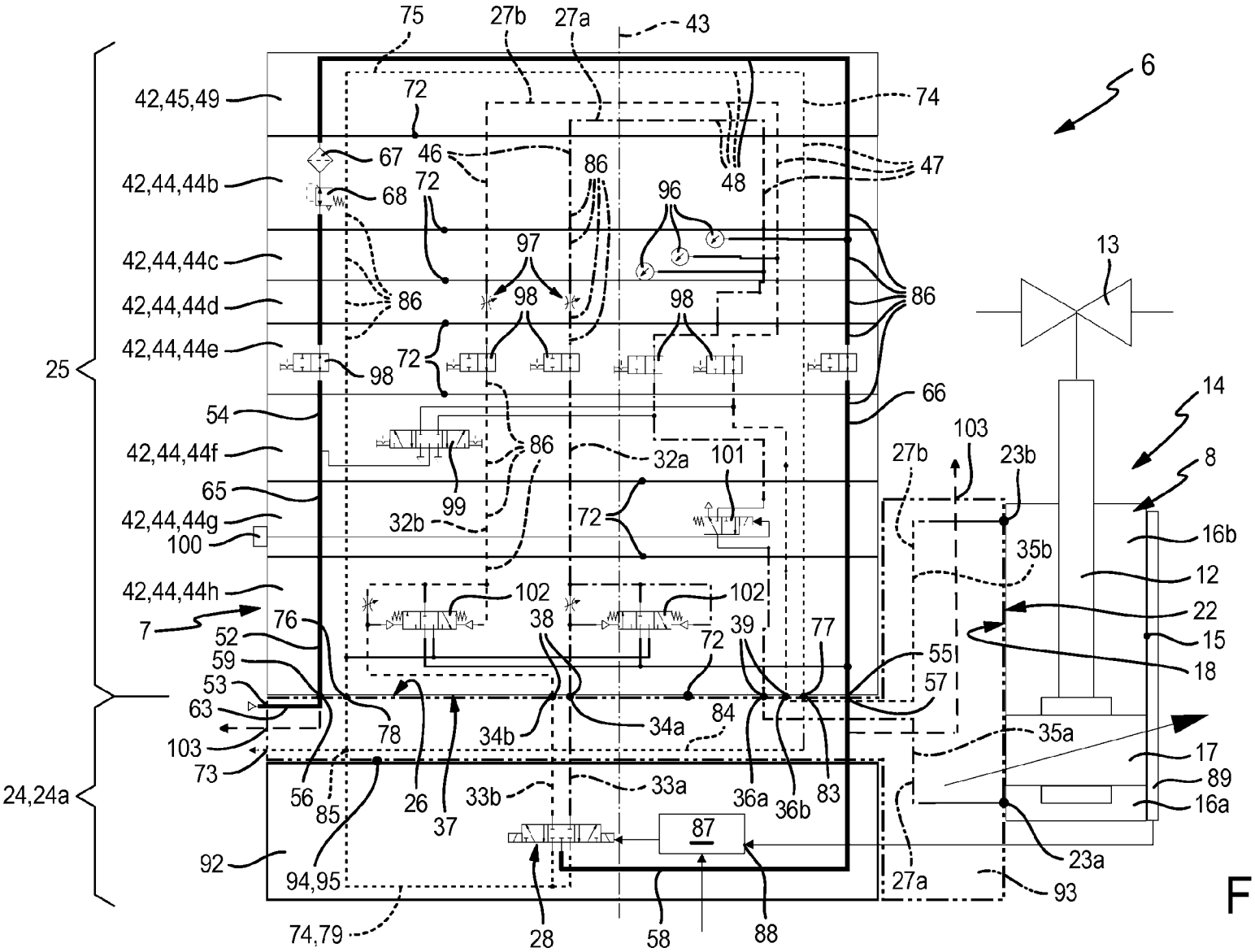
FIG. 4 is a diagrammatic representation of the arrangement from FIGS. 1 and 2, wherein, in contrast to the rotary actuator shown in FIGS. 1 and 2, a linear actuator is shown as an actuator.
Figure 5:
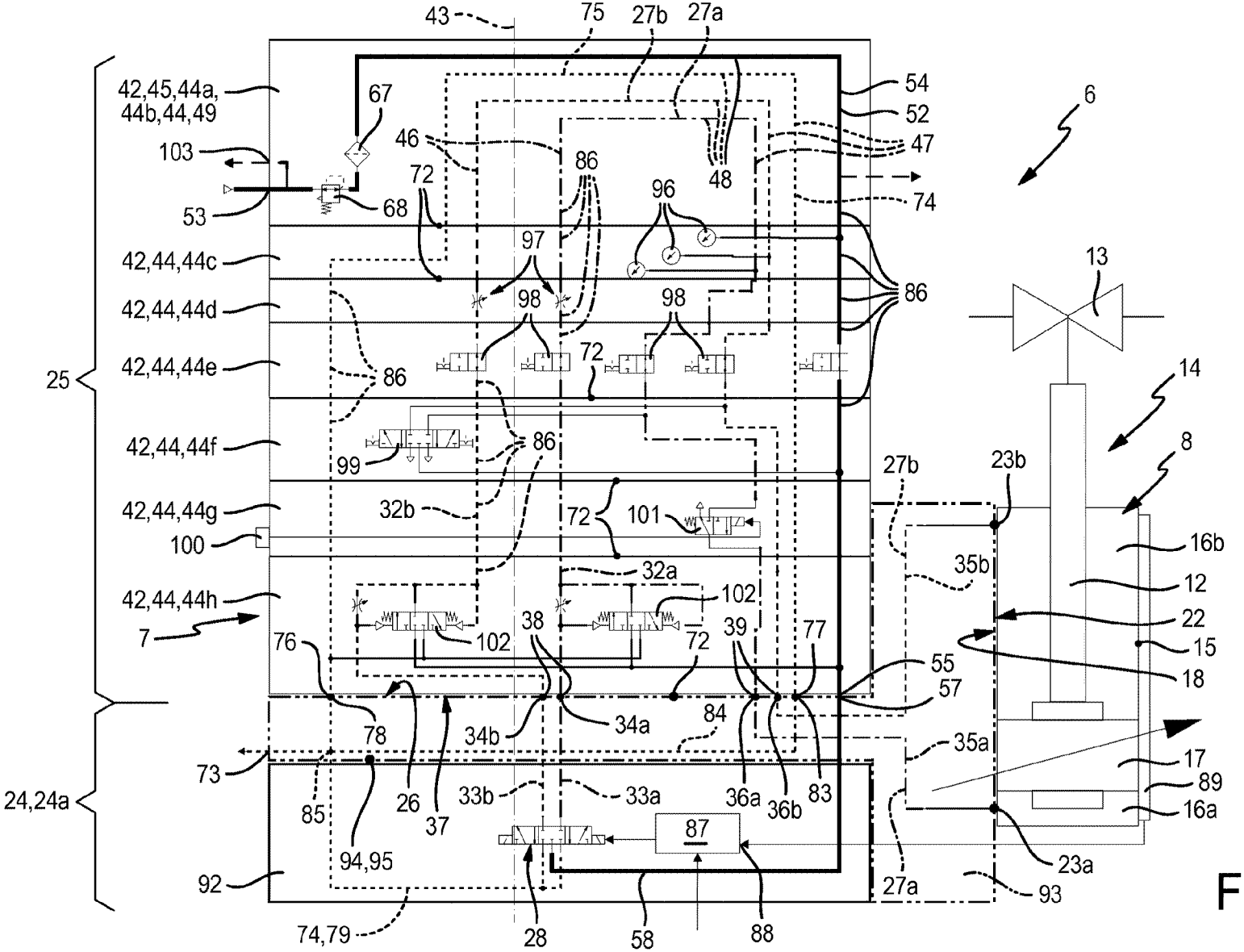
FIG. 5 is a diagrammatic representation comparable to FIG. 4 of a process control device with an associated controller, showing an embodiment of the extension module assembly which differs from that in FIG. 4.

The process control device 6 also includes a pneumatic, i.e. pneumatically actuable, actuator 8, which may a rotary actuator as shown in FIGS. 1 to 3 or a linear actuator as shown in FIGS. 4 and 5. The actuator 8 has a drive unit 12, which can be driven to perform a drive movement, the drive movement being a rotary movement in a rotary actuator and a linear movement in a linear actuator. The drive movement can be taken off for various purposes, in particular for moving and positioning any component.

The movable drive unit 12 is preferably used to actuate a valve fitting 13. In a preferred variant, which is provided in all illustrated embodiments, the actuator 8 and the valve fitting 13 are components of a process valve 14 which are combined to form an assembly. The valve fitting 13 can be incorporated into the course of a pipeline and has a valve member which is motion-coupled to the drive unit 12, for example a rotary or flat-slide valve which can be moved and positioned in various working positions by the actuator 8.

The actuator 8 has an actuator housing 15, in which the drive unit 12 separates with a piston 17 a first drive chamber 16*a* from a second drive chamber 16*b*. By a matched and controlled application of fluid to the two drive chambers 16*a*, 16*b*, the drive unit 12 can be moved and positioned. In this context, the actuator 8 has a double-acting functionality.

In an embodiment not shown in the drawing, the actuator 8 is single-acting, having only one drive chamber to which compressed air can be applied in a controlled manner, a return movement being caused by spring means.

On the outside of the actuator housing 15 a mounting interface 18 is formed. To form the process control device 8, the controller 7 is mounted there, preferably in a releasable manner, with a mounting interface described as actuator mounting interface 22 for better differentiation. At the actuator mounting interface 22 there is provided a number—corresponding to the number of drive chambers 16*a*, 16*b* to be controlled—of main working outlets 23*a*, 23*b* for compressed air required to actuate the actuator 8, so that two such main working outlets are provided by way of example; these are to be described as first main working outlet 23*a* and second main working outlet 23*b*.

If the controller 7 is secured to the mounting interface 18 by its actuator mounting interface 22, there is immediately a direct fluid connection between the first main working outlet 23*a* and the first drive chamber 16*a* on the one hand and the second main working outlet 23*b* and the second drive chamber 16*b* on the other hand. For this purpose the mounting interface 18 is provided with connection openings of fluid passages not shown in detail, which are connected to the drive chambers 16*a*, 16*b* in the housing of the actuator 8.

In an embodiment not illustrated in the drawing, the main working outlets 23*a*, 23*b* are located away from the actuator mounting interface 22, being connected to the actuator 8 using a separate connecting arrangement, in particular rigid or flexible fluid lines.

The electropneumatic controller 7 has an electropneumatic control unit 24 and an extension module assembly 25 attached to said control unit 24, preferably in a releasable manner. The actuator mounting interface 22 is expediently formed at the control unit 24 and provided in addition to an extension interface 26 likewise formed at the control unit 24, where the extension module assembly 25 is attached.

In the interior of the controller 7 there extend two separately configured first and second working passages 27*a*, 27*b*, which are designed to carry compressed air and are for easier differentiation represented by dot-dash lines in one case and by broken lines in the other case. Each of the two working passages 27*a*, 27*b* starts from one of the two main working outlets 23*a*, 23*b* and leads to electrically controllable control valve means 28, which form part of the control unit 24.

The control valve means 28 may be composed of a single control valve or of a group of control valves, having a 5/3 valve functionality by way of example. They may for example be proportional valves or else pulse width-modulated resettable switching valves. The control valve means 28 may be of a design which can be electrically actuated directly or of an electropneumatically pilot-controlled design. They are preferably accommodated in the interior of the control unit 24 and screened against the environment.

Each working passage 27*a*, 27*b* passes through the extension module assembly 25. The length section of the first working passage 27*a* which extends in the extension module assembly 25 is to be described as first extension working passage 32*a*, and the length section of the second working passage 27*b* which extends in the extension module assembly 25 is to be described as second extension working passage 32*b*.

A length section of the first working passage 27*a* starting from the control valve means 28, which is to be described as first control unit working passage 33*a*, terminates at the extension interface 26 with a pneumatic first extension working outlet 34*a*. In a comparable way, a length section of the second working passage 27*b*, which is described as second control unit working passage 33*b* and starts from the control valve means 28, extends to a second extension working outlet 34*b*, which is likewise formed at the extension interface 26.

A further length section of each working passage 27*a*, 27*b* to be describes as first or second further control unit working passage 35*a*, 35*b* leads from one of the main working outlets 23*a*, 23*b* to a port likewise located at the extension interface 26, which is to be described as first extension working inlet 36*a* in the case of the first further control unit working passage 35*a* and as second extension working inlet 36*b* in the case of the second further control unit working passage 35*b*.

The extension module assembly 25 has a module mounting interface 37 for releasable attachment to the extension interface 26 of the control unit 24. Each extension working passage 32*a*, 32*b* has two opposite passage ends, each terminating at the module mounting interface 37. Each extension working passage 32*a*, 32*b* therefore has an inlet port 38 located at the module mounting interface 37 and an outlet port 39 likewise located at the module mounting interface 37. The inlet port 38 and the outlet port 39 are placed at the module mounting interface 37 in such a way that, if the extension module assembly 25 is mounted on the control unit 24, the inlet port 38 of the first extension working passage 32*a* is connected to the first extension working outlet 34*a*, the inlet port 38 of the second extension working passage 32*b* is connected to the second extension working outlet 34*b*, the outlet port 39 of the first extension working passage 32*a* is connected to the first extension working inlet 36*a* and the outlet port 39 of the second extension working passage 32*b* is connected to the second extension working inlet 36*b*

The extension module assembly 25 preferably has a plurality of modules which are to be described as extension modules 42 for better differentiation and which are fitted to one another in a line-up direction 43 identified by a dot-dash line and firmly joined to one another, preferably in a releasable manner. The line-up direction 43 preferably extends at right angles to the dimensional plane of the extension interface 26.

The extension modules 42 include several functional modules 44 and a diverting module 45 acting as an end module 49 for the extension module assembly 25 on the side opposite the control unit 24. The functional modules 44 are incorporated in a row between the control unit 24 and the diverting module 45.

Each extension working passage 32*a*, 32*b* passes through all functional modules 44 and is diverted in the diverting module 45 by means of a diverting passage section 48 from the extension working inlet 34*a*, 34*b* to the extension working outlet 36*a*, 36*b*. Apart from the diverting module 45, each extension working passage 32*a*, 32*b* passes through all functional modules 44 twice. Each extension working passage 32*a*, 32*b* has an inlet passage branch 46 extending from the associated inlet port 38 to the diverting module 45 and an outlet passage branch 47 extending from the diverting module 45 to one of the outlet ports 39. For each extension working passage 32*a*, 32*b*, a diverting passage section 48, which has an in particular U-shaped longitudinal route and connects one of the inlet passage branches 46 to one of the outlet passage branches 47, extends in the diverting module 45.

Each extension working passage 32*a*, 32*b* therefore passes through the extension module assembly 25 with a substantially U-shaped passage route, the ends of the U-legs being located at the module mounting interface 37.

In a controller 7 designed for controlling an single-acting actuator 8, one of the two working passages 27*a*, 27*b* including the associated ports can obviously be omitted.

The extension modules 42 are preferably plate- or block-shaped. They expediently have a polygonal and in particular rectangular outline, but can by all means have an at least partially circular outline as well. The outline defines the outer contour of the extension modules 42 oriented at right angles to the line-up direction 43.

In addition, an air supply passage 52 passes through the controller 7; this supplies the control valve means 28 with compressed air which is in a controlled manner fed into the drive chambers 16*a*, 16*b* of the actuator 8 or discharged therefrom through the working passages 27*a*, 27*b*, in order to move the drive unit 12 and to position it as required. The air supply passage 52 expediently also provides a control aid air, which may be required for valve actuation if the control valve means 28 are pilot-controlled control valve means.

The air supply passage 52 is connected to at least one air feed-in port 53 located at an outer surface of the controller 7 and designed for connection to an external compressed air source not shown in detail. The compressed air source is preferably connected by means of separate pipelines or hoses.

According to the embodiment shown in FIG. 4, the air feed-in port 53 can be located at the control unit 24. This offers the possibility (not illustrated) to route the air supply passage 52 starting from the air feed-in port 53 exclusively in the interior of the control unit 24 for a direct fluid connection to the control valve means 28.

It is deemed to be particularly advantageous, however, if the air supply passage 52 extends through the extension module assembly 25. This is the case in all of the illustrated embodiments, wherein, according to the variant shown in FIG. 5, the air feed-in port 53 at the control unit 24 can be omitted, being instead located at one of the extension modules 42. In the embodiment illustrated in FIG. 5, the air feed-in port 53 is formed at the diverting module 45, which here, in contrast to the embodiment of FIG. 4, acts not only as a mere diverting module 45 but also forms a functional module 44, i.e. an air feed-in module 44*a*.

It is of course possible to configure a functional module 44 which is separate from the diverting module 45 as an air feed-in module 44*a*.

For better differentiation, that section of the air supply passage 52 which extends in the extension module assembly 25 is to be describes as extension air supply passage 45. It connects the at least one air feed-in port 53 to an outlet port 55, which is formed at the module interface 37 and is, if the extension module assembly 25 is mounted at the extension interface 26, connected to an extension supply inlet 57, which is formed at the extension interface 26 and connected via a length section of the air supply passage 52, which extends in the control unit 24 and is to be described as control unit air supply passage 58, to the control valve means 28 for the compressed air supply thereof.

The extension air supply passage 54 is preferably designed such that it passes at least once through all existing functional modules 44 and preferably through all existing extension modules 42. If the air feed-in port 53 is located at the diverting module 45 according to FIG. 5, it expediently passes only once through the existing functional modules 44 on the way to the extension supply inlet 57.

According to both embodiments, the extension air supply passage 54 is preferably designed such that it passes through the diverting module 45 as well and has a diverting passage section 48 extending in the diverting module 45.

If the air feed-in port 53 is located at the control unit 24 as in the embodiment of FIG. 4, the air supply passage 52 expediently has a length section which starts from the air feed-in port 53 and extends in the control unit 24, is to be described as inlet-side control unit air supply passage 63 and terminates at the extension interface 26 with an extension supply outlet 56. This extension supply outlet 56 communicates with an opposite inlet port 59 at the module interface 37, which defines the end region of the extension air supply passage 54 which is opposite the outlet port 55. An inlet passage branch 65 of the extension supply passage 54, which starts from the inlet port 59, extends in the line-up direction 43 to the diverting module 45, where it merges into the associated diverting passage section 48, which is continued in an outlet passage branch 66 of the extension supply passage 54; this in turn extends in the line-up direction 43 to the outlet port 55.

In this way, the extension air supply passage 54 likewise has a U-shaped passage route with passage ends located at the module mounting interface 37.

If the air feed-in port 53 is not provided at the control unit 24, it can be located at one of the functional modules 44 in such a way that it is connected to the inlet passage branch 65. That length section of the inlet passage branch 65 which then extends from the air feed-in port 53 to the inlet port 59 is functionless in this case. It may for example be provided that in the embodiment of FIG. 4 the functional module 44 immediately adjoining the diverting module 45 is designed as an air feed-in module 44*a*.

It is advantageous if the air feed-in module 44*a* is at the same time designed as an air treatment module 44*b*, which applies to the embodiment of FIG. 5 and which would be the case in the embodiment of FIG. 4 if the air treatment module 44*b* immediately adjoining the diverting module 45 were equipped with an air feed-in port in the manner mentioned above.

The air treatment module 44*b* is preferably equipped with a filter 67 and/or a pressure controller 68 in order to free the compressed air fed in from the external compressed air source of impurities and to establish a desired operating pressure.

The extension module assembly 25 expediently comprises a plurality of functional modules 44, which differ from one another in their functionality, so that we can speak of different types of functional modules. Each functional module 44 contains suitable functional means, whereby the compressed air flowing in the extension module assembly 25 during the operation of the controller 7 can be influenced and/or which in turn can be influenced by said compressed air flowing in the controller 7.

Each functional module 44 incorporated between the diverting module 45 and the control unit 24 has two mutually opposite coupling interfaces 72. By way of example, these coupling interfaces 72 are located at mutually opposite end faces of a respective functional module 44 with respect to the line-up direction 43. The diverting module 45 in turn has a corresponding coupling interface 72 on the side facing the control unit 24.

The coupling interfaces 72 are designed such that functional modules 44 of different functionality can be installed in any sequence between the control unit 24 and the diverting module 45. In this, the respective extension modules 42 are placed against one another by their facing coupling interfaces 72 and secured to one another, preferably in a releasable manner, by suitable fastening means not shown in the drawing.

Fastening means are preferably provided for exclusively securing adjacent extension modules 42 to one another, wherein the extension module 42 fitted to the control unit 24 can be or is secured to the control unit 24 independently of the other extension modules 42. Alternatively, however, fastening measures may be provided whereby all extension modules 42 can be jointly fixed to the control unit 24; such fastening means may be ties rod fastening means, for example.

That coupling interface 72 of the extension module 42 located immediately adjacent to the control unit 12 which faces the extension interface 26 forms the module interface 37 mentioned above. In a minimally equipped extension module assembly 25, the extension module assembly 25 attached to the control unit 24 has the diverting module 45 as a single extension module 42, so that the coupling interface 72 forms the module interface 37.

In the appropriate switching position of the control valve means 28, compressed air fed in at the air feed-in port 53 and fed to the control valve means 28 via the control unit air supply passage 59 is fed via at least one of the two working passages 27*a*, 27*b* into at least one of the two drive chambers 16*a*, 16*b* of the actuator 8. The control valve means 28 are moreover capable of discharging compressed air from the drive chambers 16*a*, 16*b* through the working passages 27*a*, 27*b* for the pressure relief of the respective drive chamber 16*a*, 16*b*. The compressed air discharged in this way can be discharged to atmosphere through an air discharge opening 73 located at the outer surface of the controller 7. This is based on an air discharge passage 74 passing through the controller 7 and indicated in FIGS. 4 and 5 by dotted lines.

One end of the air discharge passage 74 is connected to the control valve means 28 in the control unit 24, while the other end leads to the air discharge opening 73. According to an embodiment not illustrated, it may exclusively extend within the control unit 24, not running through the extension module assembly 25.

In the illustrated embodiments, the air discharge passage 74 passes through the extension module assembly 25 as well. It has a length section described as extension air discharge passage 75, which, comparable to the extension working passages 32*a*, 32*b*, passes through the extension module assembly 25 preferably in a U-shape, one end terminating at the mounting interface 37 with an inlet port 76, the other end with an outlet port 77. The inlet port 76 communicates with an extension discharge outlet 78 formed on the opposite side at the extension interface 26, which extension discharge outlet 78 is a part of a length section of the air discharge passage 74 located in the control unit 24 and there extending to the control valve means 28; this is to be described as control unit air discharge passage 79.

The outlet port 77 of the extension air discharge passage 75 communicates with an extension discharge inlet 83, which is formed opposite at the extension interface 26 and is a part of a further control unit air discharge passage 84, which likewise extends in the control unit 24 and is a length section of the air discharge passage 74. This further control unit air discharge passage 84 terminates at the air discharge opening 73. The control unit air discharge passage 79 and the further control unit air discharge passage 84 are expediently connected to each other at a passage connecting point 85 within the control unit 24, resulting in a short venting path for the control valve means 28. The extension air discharge passage 75 extending in the extension module assembly 25 is expediently used for venting functional components in the functional modules 44, which is however not shown in the drawing for reasons of clarity.

The fluid passages extending in the line-up direction 43 through the extension module assembly 25—these being the two extension working passages 32*a*, 32*b* of the extension air supply passage 54 and the extension air discharge passage 75 in the illustrated embodiment—are in each case composed of passage length sections 86, which pass through the individual extension modules 42 in the line-up direction 43 and are connected to one another at the contacting coupling interfaces 72 with passage orifices provided there. This applies to all extension modules 42 apart from the diverting module 45, in which the diverting passage sections mentioned above and terminating only at the single coupling interface 72 extend. For clarity, only parts of the passage length sections 86 passing through the extension modules 42 are provided with reference symbols in the drawing.

In the joint region between two adjacent extension modules 42, sealing means not shown in detail are obviously provided to seal the fluid transfer between adjacent extension modules 42 against the environment.

The control unit 24 is equipped with control electronics 87, which are connected to the control valve means 28 in terms of selection technology and can transmit electric control signals predetermining the operating state of the switching position of the control valve means 28 to the control valve means 28. The electric control signals are generated in the control electronics 87, taking account of feedback signals fed into at least one feedback signal input 88 in the control unit 24 or into control electronics 87. The feedback signals come from the actuator 8 and are generated in the operation of the process control device 6 as a function of the position of the drive unit 12.

The feedback signals preferably come from a detection device 89 belonging to the actuator 8, which responds to the movement and/or position of the drive unit 12 and outlets the feedback signals as a function thereof. By way of example, the detection device 89 is a position sensing system which can continuously sense the position of the drive unit 12. In a simple case, however, the detection device 89 can be represented by one or more position sensors only.

The control unit 24 is preferably designed as a positioner unit 24*a*, which applies to the illustrated embodiments. For this purpose, the control electronics 87 have a positioning functionality and are capable of selecting the control valve means 28, as a function of the feedback signals received as actual values, in such a way that the drive unit 2 is controlled in terms of a target position which can be preset as target value by an external control device connected to the control electronics 87. The control unit 24 is therefore a so-called positioner in particular.

According to the embodiment of FIG. 3, the control unit 24 can be represented by a single module which can be described as control unit module 24*b*. This control unit module 24*b* expediently comprises both the actuator mounting interface 22 and the extension interface 26. The controller 7 is in this case composed in a modular manner of the control unit module 24*b* and the extension module assembly 25.

More variable applications are offered by the embodiment of a controller 7 as shown in FIGS. 1, 2, 4 and 5, in which the control unit 24 is in turn modular and in particular composed of two modules, i.e. of a control module 92 responsible for the actual open- or closed-loop control process on the one hand and a passage splitter module 93 responsible for an advantageous Passage distribution on the other hand. For better recognition, the passage splitter module 93 is indicated in FIGS. 4 and 5 by double dot-dash lines.

The control unit 24 has a first internal interface 94 located at the control module 92 and a matching second internal interface 95 located at the passage splitter module 93. The control module 92 and the passage splitter module 93 are attached to each other by these two internal interfaces 94, 95, preferably in a releasable manner. The extension interface 26 and preferably the actuator mounting interface 22 are located at the passage splitter module 93, including the fluid ports provided at the interfaces 26, 22. This being so, the control module 92 can be removed if required without having to remove the extension module assembly 25 or the actuator 8. This for example facilitates a replacement of the control module 92 if another open- or closed-loop control functionality is required.

The air feed-in port 53 and the air discharge opening 73, which are provided at the control unit 24, are expediently located at the passage splitter module 93 as well.

The two control unit working passages 33*a*, 33*b*, the control unit air supply passage 58 and the control unit air discharge passage 79 are divided in the module joint region defined by the two internal interfaces 94, 95 and have openings which communicate with one another in accordance with their assignment if the control module 92 and the passage splitter module 93 are attached to each other at the two internal interfaces 94, 95.

The passage splitter module 93 is used to divide the passages between the control module 92 and the extension module assembly 25.

Fastening means not shown in detail facilitate a releasable fixing of the control module 92 at the passage splitter module 93.

The passage splitter module 93 can be configured arbitrarily in principle. An L-shape according to FIGS. 1 and 2 and a T-shape according to FIGS. 4 and 5 are deemed to be particularly advantageous.

The functional modules 44 can have any functionality suitable for the operation of the process control device 6. Particularly preferred functional modules 44 are integrated into the extension module assembly 25 in the embodiments of FIGS. 4 and 5 and are explained below.

The air feed-in module 44*a* and the air treatment module 44*b* have already been explained above.

At least one functional module 44 is expediently designed as an indicating module 44*c*. It is preferably provided with indicating means 96 capable of indicating the pressure in at least one of the extension working passages 32*a*, 32*b* and/or in the extension air supply passage 54.

The indicating module can easily be designed for the alternative or additional indication of other relevant characteristics, such as flow rate or temperature. The indicating means 96 are in particular designed for visual display.

At least one functional module 44 can be designed as a restrictor module 44*d* for restricting the flow in the at least one extension working passage 32*a*, 32*b*. It has suitable restricting means 97, which may be designed as fixed or adjustable restrictors.

At least one functional module 44 can be designed as an interrupt module 44*e*, by which the passages passing through can be interrupted, i.e. blocked, so that the control unit 24 is decoupled fluidically and can be exchanged easily. The interrupt module 44*e* is provided with internal valve means 98, which are incorporated into the passage connections and can preferably be actuated manually.

At least one functional module 44 is expediently designed as a manual actuation module 44*f*, into which a valve device 99 is integrated between the extension air supply passage 54 and the at least one extension working passage 32*a*, 32*b*; by actuating this valve device 99, the actuator 8 can be actuated manually independently of the control unit 24.

At least one functional module 44 is preferably an emergency shutoff module 44*g* to secure safety-relevant parts of the system equipped with the process control device. It has an electric connection 100 for feeding in emergency shutoff signals and an integrated emergency shutoff valve 101 which can be actuated thereby.

At least one functional module 44 is expediently designed as a boost module 44*h* having at least one booster stage 102, which is incorporated into the run of the at least one extension working passage 32*a*, 32*b* and moreover connected to the extension air supply passage 54 and which is used to boost the fluid pressure outlet by the control valve means 28 in order to be able to actuate even large actuators 8 sufficiently fast.

At least one component of the controller 7 expediently has an unregulated compressed air outlet 103, which in the embodiment of FIG. 4 is located at the control unit 24 and there at the passage splitter module 93 in particular and which in the embodiment of FIG. 5 is a part of the air feed-in module 44*b*. Here compressed air can be tapped for purposes not connected to the operation of the process control device 6.

The invention claimed is:

1. An electropneumatic controller with an actuator mounting interface for attaching to a pneumatic actuator, and with an electropneumatic control unit comprising a control electronics designed for processing feedback signals of the actuator and comprising control valve means electrically controllable by the control electronics, the control unit having at least one pneumatic main working outlet for pneumatic connection to a drive chamber of the actuator to be controlled, wherein the control unit has an extension interface, on which at least one pneumatic extension working outlet communicating with the control valve means and at least one pneumatic extension working inlet communicating with a pneumatic main working outlet are provided, and wherein the controller has an extension module assembly attached or able to be attached to the extension interface, wherein at least one extension working passage connecting an extension working outlet of the control unit to an extension working inlet of the control unit passes through the extension module assembly, and wherein the extension module assembly contains a diverting module diverting the extension working passage from the extension working outlet to the extension working inlet.

2. The controller according to claim 1, wherein the extension working outlet, the extension working inlet and the main working outlet are provided in duplicate, wherein two independent extension working passages, both of which are diverted in the diverting module, pass through the extension module assembly.

3. The controller according to claim 1, wherein the actuator mounting interface is located at the electropneumatic control unit.

4. The controller according to claim 1, wherein the diverting module terminates the extension module assembly on the side opposite the control unit.

5. The controller according to claim 1, wherein the extension module assembly has at least one functional module, wherein the compressed air flowing in the extension module assembly in the operation of the controller can be influenced by the at least one functional module or wherein the at least one functional module can in turn be influenced by said flowing compressed air.

6. The controller according to claim 5, wherein the diverting module is simultaneously designed as a functional module.

7. The controller according to claim 5, wherein the extension module assembly has at least one functional module which is separate from the diverting module and which is able to be installed or is installed between the diverting module and the control unit.

8. The controller according to claim 5, wherein the extension module assembly has several functional modules of different functionality, which are separate from the diverting module and can be installed or are installed in a row between the control unit and the diverting module.

9. The controller according to claim 5, wherein each functional module has two coupling interfaces, which are located opposite each other in a line-up direction and which are designed such that functional modules of different functionality can be installed in any sequence between the control unit and the diverting module.

10. The controller according to claim 5, wherein, among the functional modules there is provided at least one module selected from the group consisting of an air treatment module, an indicating module a restrictor module, an interrupt module, a manual actuation module, an emergency shutoff module, a boost module and an air feed-in module.

11. The controller according to claim 1, wherein an air feed-in port is provided at one or both of the control unit and at of the extension module assembly, the air feed-in port communicating with an extension air supply passage, which passes through the extension module assembly, wherein the extension air supply passage is in fluid connection with the control valve means for the supply of compressed air.

12. The controller according to claim 1, wherein there are formed at the extension interface of the control unit an extension supply outlet communicating with an air feed-in port of the control unit and an extension supply inlet communicating with the control valve means of the control unit, wherein an extension air supply passage passing through the extension module assembly and diverted in the diverting module is connected to the extension supply outlet and to the extension supply inlet.

13. The controller according to claim 1, wherein the at least one main working outlet is located at the actuator mounting interface of the control unit in such a way that there is a direct fluid connection between an extension working passage and the actuator if the control unit is attached to an actuator.

14. The controller according to claim 1, wherein the control unit is designed as a positioner unit, the control electronics of which has a closed-loop control functionality.

15. The controller according to claim 1, wherein the control unit has a modular structure, wherein the control unit is provided with a control module comprising the control electronics and the control valve means connected thereto as well as at least one signal input for receiving feedback signals, and wherein the control unit furthermore has a separate passage splitter module, which is attached to the control module, wherein the extension interface is formed at the passage splitter module.

16. A process control device comprising a pneumatic actuator and an electropneumatic controller for the pneumatic actuator, wherein the electropneumatic controller has an actuator mounting interface, by which it is attached to the pneumatic actuator, and an electropneumatic control unit, wherein the electropneumatic control unit comprises a control electronics designed for processing feedback signals of the actuator and also comprises control valve means electrically controllable by the control electronics, the control unit having at least one pneumatic main working outlet for pneumatic connection to a drive chamber of the actuator to be controlled, wherein the control unit has an extension interface, on which at least one pneumatic extension working outlet communicating with the control valve means and at least one pneumatic extension working inlet communicating with a pneumatic main working outlet are provided, and wherein the controller has an extension module assembly attached or able to be attached to the extension interface, wherein at least one extension working passage connecting an extension working outlet of the control unit to an extension working inlet of the control unit passes through the extension module assembly, and wherein the extension module assembly contains a diverting module diverting the extension working passage from the extension working outlet to the extension working inlet.

17. The process control device according to claim 16, wherein the pneumatic actuator is a part of a process valve and is used for the actuation of a valve fitting of the process valve.

18. The controller according to claim 11, wherein the extension air supply passage is also diverted in the diverting module.

19. The controller according to claim 14, wherein the closed-loop control functionality of the control electronics is a positioning functionality.

20. The controller according to claim 15, wherein the actuator mounting interface is also formed at the passage splitter module.

* * * * *